US009558881B2

(12) United States Patent
Liu et al.

(10) Patent No.: US 9,558,881 B2
(45) Date of Patent: Jan. 31, 2017

(54) HIGH CURRENT POWER INDUCTOR

(71) Applicant: COOPER TECHNOLOGIES COMPANY, Houston, TX (US)

(72) Inventors: Zhuomin Liu, Dublin (CA); Robert James Bogert, Lake Worth, FL (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 153 days.

(21) Appl. No.: 14/217,705

(22) Filed: Mar. 18, 2014

(65) Prior Publication Data

US 2014/0313003 A1 Oct. 23, 2014

Related U.S. Application Data

(60) Continuation-in-part of application No. 13/709,793, filed on Dec. 10, 2012, now Pat. No. 9,275,787, which is a division of application No. 12/535,981, filed on Aug. 5, 2009, now Pat. No. 8,400,245, which is a continuation-in-part of application No. 12/247,821, filed on Oct. 8, 2008, now Pat. No. 8,310,332.

(60) Provisional application No. 61/080,115, filed on Jul. 11, 2008.

(51) Int. Cl.

| | |
|---|---|
| ***H01F 27/24*** | (2006.01) |
| ***H01F 27/30*** | (2006.01) |
| ***H01F 17/04*** | (2006.01) |
| ***H01F 27/255*** | (2006.01) |
| ***H01F 27/28*** | (2006.01) |
| ***H01F 27/29*** | (2006.01) |
| *H01F 3/14* | (2006.01) |

(52) U.S. Cl.

CPC ..... *H01F 27/303* (2013.01); *H01F 17/04* (2013.01); *H01F 17/043* (2013.01); *H01F 27/255* (2013.01); *H01F 27/2847* (2013.01); *H01F 27/292* (2013.01); *H01F 27/306* (2013.01); *H01F 3/14* (2013.01)

(58) Field of Classification Search

CPC ..... H01F 27/303
USPC ..... 336/212
See application file for complete search history.

(56) References Cited

U.S. PATENT DOCUMENTS

| | | | |
|---|---|---|---|
| 2,391,563 | A | 12/1945 | Goldberg |
| 3,255,512 | A | 6/1966 | Lochner et al. |
| 4,072,780 | A | 2/1978 | Zillman |

(Continued)

FOREIGN PATENT DOCUMENTS

| | | | |
|---|---|---|---|
| EP | 0655754 | A1 | 5/1995 |
| EP | 1150312 | A2 | 10/2001 |

(Continued)

OTHER PUBLICATIONS

International Preliminary Report on Patentability and Written Opinion of PCT/US2009057471; Apr. 21, 2011; 6 pages.

(Continued)

*Primary Examiner* — Mangtin Lian
*Assistant Examiner* — Ronald Hinson
(74) *Attorney, Agent, or Firm* — Armstrong Teasdale LLP

(57) ABSTRACT

A surface mount power inductor includes a preformed conductive winding clip and first and second-shaped core pieces. The core pieces may be configured to reduce unbalanced force experienced in the power inductor in certain types of power management circuitry. Reduction in the unbalanced force reduces vibration of the power inductor in use, and in turn reduces acoustic noise as the power inductor operates.

38 Claims, 11 Drawing Sheets

(56) References Cited

U.S. PATENT DOCUMENTS 4,313,152 A 1/1982 Vranken
4,543,553 A 9/1985 Mandai et al.
4,689,594 A 8/1987 Kawabata et al.
4,750,077 A 6/1988 Amagasa
4,758,808 A 7/1988 Sasaki et al.
4,803,425 A 2/1989 Swanberg
4,873,757 A 10/1989 Williams
5,032,815 A 7/1991 Kobayashi et al.
5,045,380 A 9/1991 Kobayashi et al.
5,250,923 A 10/1993 Ushiro et al.
5,257,000 A 10/1993 Billings et al.
5,300,911 A 4/1994 Walters
5,463,717 A 10/1995 Takatori et al.
5,500,629 A 3/1996 Meyer et al.
5,515,022 A 5/1996 Tashiro et al.
5,532,667 A 7/1996 Haertling et al.
5,572,180 A 11/1996 Huang et al.
5,664,069 A 9/1997 Takatori et al.
5,761,791 A 6/1998 Bando
5,821,638 A 10/1998 Boys et al.
5,849,355 A 12/1998 McHenry
5,875,541 A 3/1999 Kumeji et al.
5,945,902 A 8/1999 Lipkes et al.
6,038,134 A 3/2000 Belter
6,054,914 A 4/2000 Abel et al.
6,107,907 A 8/2000 Leigh et al.
6,114,939 A 9/2000 Wittenbreder
6,169,801 B1 1/2001 Levasseur et al.
6,198,374 B1 3/2001 Abel
6,198,375 B1 3/2001 Shafer
6,204,744 B1 3/2001 Shafer et al.
6,287,931 B1 9/2001 Chen
6,293,001 B1 9/2001 Uriu et al.
6,366,192 B2 4/2002 Person et al.
6,379,579 B1 4/2002 Harada
6,392,525 B1 5/2002 Kato et al.
6,420,953 B1 7/2002 Dadafshar
6,449,829 B1 9/2002 Shafer
6,460,244 B1 10/2002 Shafer et al.
6,566,731 B2 5/2003 Ahn et al.
6,593,841 B1 7/2003 Mizoguchi et al.
6,628,531 B2 9/2003 Dadafshar
6,631,545 B1 10/2003 Uriu et al.
6,653,196 B2 11/2003 Ahn et al.
6,658,724 B2 12/2003 Nakano et al.
6,713,162 B2 3/2004 Takaya et al.
6,720,074 B2 4/2004 Zhang et al.
6,749,827 B2 6/2004 Smalley et al.
6,750,723 B2 6/2004 Yoshida et al.
6,791,445 B2 9/2004 Shibata et al.
6,794,052 B2 9/2004 Schultz et al.
6,797,336 B2 9/2004 Garvey et al.
6,808,642 B2 10/2004 Takaya et al.
6,817,085 B2 11/2004 Uchikoba et al.
6,835,889 B2 12/2004 Hiraoka et al.
6,864,201 B2 3/2005 Schultz et al.
6,879,238 B2 4/2005 Liu et al.
6,882,261 B2 4/2005 Moro et al.
6,885,276 B2 4/2005 Iha et al.
6,897,718 B2 5/2005 Yoshida et al.
6,908,960 B2 6/2005 Takaya et al.
6,927,738 B2 8/2005 Senba et al.
6,936,233 B2 8/2005 Smalley et al.
6,946,944 B2 9/2005 Shafer et al.
6,949,237 B2 9/2005 Smalley et al.
6,952,355 B2 10/2005 Riggio et al.
6,971,391 B1 12/2005 Wang et al.
6,979,709 B2 12/2005 Smalley et al.
6,986,876 B2 1/2006 Smalley et al.
6,998,939 B2 2/2006 Nakayama et al.
7,008,604 B2 3/2006 Smalley et al.
7,019,391 B2 3/2006 Tran
7,034,091 B2 4/2006 Schultz et al.
7,034,645 B2 4/2006 Shafer et al.
7,041,620 B2 5/2006 Smalley et al.
7,048,999 B2 5/2006 Smalley et al.
7,069,639 B2 7/2006 Choi et al.
7,071,406 B2 7/2006 Smalley et al.
7,078,999 B2 7/2006 Uriu et al.
7,081,803 B2 7/2006 Takaya et al.
7,087,207 B2 8/2006 Smalley et al.
7,091,412 B2 8/2006 Wang et al.
7,091,575 B2 8/2006 Ahn et al.
7,105,596 B2 9/2006 Smalley et al.
7,108,841 B2 9/2006 Smalley et al.
7,127,294 B1 10/2006 Wang et al.
7,142,066 B1 11/2006 Hannah et al.
7,162,302 B2 1/2007 Wang et al.
7,205,069 B2 4/2007 Smalley et al.
7,213,915 B2 5/2007 Tsutsumi et al.
7,221,249 B2 5/2007 Shafer et al.
7,262,482 B2 8/2007 Ahn et al.
7,263,761 B1 9/2007 Shafer et al.
7,294,366 B2 11/2007 Renn et al.
7,319,599 B2 1/2008 Hirano et al.
7,330,369 B2 2/2008 Tran
7,339,451 B2 3/2008 Liu et al.
7,345,562 B2 3/2008 Shafer et al.
7,354,563 B2 4/2008 Smalley et al.
7,375,417 B2 5/2008 Tran
7,380,328 B2 6/2008 Ahn et al.
7,390,477 B2 6/2008 Smalley et al.
7,390,767 B2 6/2008 Smalley et al.
7,393,699 B2 7/2008 Tran
7,400,512 B2 7/2008 Hirano et al.
7,419,624 B1 9/2008 Smalley et al.
7,419,651 B2 9/2008 Smalley et al.
7,442,665 B2 10/2008 Schultz et al.
7,445,852 B2 11/2008 Maruko et al.
7,481,989 B2 1/2009 Smalley et al.
7,485,366 B2 2/2009 Ma et al.
7,489,537 B2 2/2009 Tran
7,525,406 B1 * 4/2009 Cheng ..... H01F 17/043 336/232
7,567,163 B2 7/2009 Dadafshar et al.
7,915,987 B2 3/2011 Qu
8,310,332 B2 11/2012 Yan et al.
8,400,245 B2 3/2013 Yan et al.
2001/0016977 A1 8/2001 Moro et al.
2001/0043135 A1 11/2001 Yamada et al.
2002/0009577 A1 1/2002 Takaya et al.
2002/0084880 A1 7/2002 Barbera-Guilem et al.
2003/0029830 A1 2/2003 Takaya et al.
2003/0184423 A1 10/2003 Holdahl et al.
2004/0017276 A1 1/2004 Chen et al.
2004/0113741 A1 6/2004 Li et al.
2004/0174239 A1 9/2004 Shibata et al.
2004/0209120 A1 10/2004 Inoue et al.
2004/0210289 A1 10/2004 Wang et al.
2005/0151614 A1 7/2005 Dadafshar
2005/0174207 A1 8/2005 Young et al.
2005/0184848 A1 8/2005 Yoshida et al.
2005/0188529 A1 9/2005 Uriu et al.
2006/0038651 A1 2/2006 Mizushima et al.
2006/0049906 A1 3/2006 Liu et al.
2006/0145800 A1 7/2006 Dadafshar et al.
2006/0273670 A1 * 12/2006 Tung ..... H02K 1/145 310/67 R
2007/0030108 A1 2/2007 Ishimoto et al.
2007/0057755 A1 3/2007 Suzuki et al.
2007/0159289 A1 7/2007 Lee et al.
2007/0252669 A1 * 11/2007 Hansen ..... H01F 17/06 336/212
2008/0001702 A1 1/2008 Brunner
2008/0061917 A1 3/2008 Manoukian et al.
2008/0110014 A1 5/2008 Shafer et al.
2008/0278275 A1 11/2008 Fouquet et al.
2008/0310051 A1 12/2008 Yan et al.
2009/0058588 A1 3/2009 Suzuki et al.
2009/0179723 A1 7/2009 Ikriannikov et al.
2009/0302512 A1 12/2009 Gablenz et al.
2010/0007453 A1 1/2010 Yan et al.
2010/0007457 A1 1/2010 Yan et al.
2010/0026443 A1 2/2010 Yan et al.

(56) References Cited

U.S. PATENT DOCUMENTS

| | | | |
|---|---|---|---|
| 2010/0039200 | A1 | 2/2010 | Yan et al. |
| 2010/0085139 | A1 | 4/2010 | Yan et al. |
| 2010/0171579 | A1 | 7/2010 | Yan et al. |
| 2010/0171581 | A1 | 7/2010 | Manoukian et al. |
| 2010/0259351 | A1 | 10/2010 | Bogert et al. |
| 2010/0259352 | A1 | 10/2010 | Yan et al. |
| 2010/0271161 | A1 | 10/2010 | Yan et al. |
| 2010/0277267 | A1 | 11/2010 | Bogert et al. |
| 2011/0121928 | A1 | 5/2011 | Qu |
| 2013/0099886 | A1 | 4/2013 | Yan et al. |

FOREIGN PATENT DOCUMENTS

| | | | |
|---|---|---|---|
| EP | 1288975 | A2 | 3/2003 |
| EP | 1288975 | A3 | 4/2003 |
| EP | 1486991 | A1 | 12/2004 |
| EP | 1526556 | A1 | 4/2005 |
| EP | 1564761 | A1 | 8/2005 |
| JP | 6423121 | | 2/1989 |
| JP | 07272932 | | 10/1995 |
| JP | 2700713 | | 1/1998 |
| JP | 10106839 | | 4/1998 |
| JP | 3108931 | | 11/2000 |
| JP | 3160685 | | 4/2001 |
| JP | 2001257124 | | 9/2001 |
| JP | 2002057049 | | 2/2002 |
| JP | 2002313632 | | 10/2002 |
| JP | 2005260130 | | 9/2005 |
| KR | 2001014533 | | 2/2001 |
| KR | 20020071285 | | 9/2002 |
| KR | 20030081738 | | 10/2003 |
| WO | 9205568 | | 4/1992 |
| WO | 2005008692 | A2 | 1/2005 |
| WO | 2006063081 | A2 | 6/2006 |
| WO | 2008008538 | A2 | 1/2008 |
| WO | 200911375 | A2 | 9/2009 |

OTHER PUBLICATIONS

International Search Report and Written Opinion of PCT/US2011/024714; Apr. 21, 2011; 14 pages.

International Search Report and Written Opinion of PCT/US2010/032803; Aug. 23, 2010; 16 pages.

International Search Report and Written Opinion of PCT/US2010/032992; Jul. 28, 2010; 15 pages.

International Search Report and Written Opinion of PCT/US2009/057471; Dec. 14, 2009; 14 pages.

International Search Report and Written Opinion of PCT/US2009/051005; Sep. 23, 2009; 15 pages.

* cited by examiner

HIGH CURRENT POWER INDUCTOR

CROSS REFERENCE TO RELATED APPLICATIONS

This application is a continuation-in-part application of U.S. patent application Ser. No. 13/709,793 filed Dec. 10, 2012, which is a division of U.S. patent application Ser. No. 12/535,981 filed Aug. 5, 2009, which is a continuation-in-part application of U.S. application Ser. No. 12/247,821 filed Oct. 8, 2008 (now issued U.S. Pat. No. 8,310,332) that claims the benefit of U.S. Provisional Patent Application No. 61/080,115 filed Jul. 11, 2008, the complete disclosures of which are hereby incorporated by reference in their entirety.

TECHNICAL FIELD

The field of the invention relates generally to electronic components and methods of manufacturing these components and, more particularly, to inductors, transformers, and the methods of manufacturing such items.

BACKGROUND

Typical inductors may include toroidal cores and shaped-cores, including a shield core and drum core, U core and I core, E core and I core, and other matching shapes. The typical core materials for these inductors are ferrite or normal powder core materials, which include iron (Fe), Sendust (Al—Si—Fe), MPP (Mo—Ni—Fe), and HighFlux (Ni—Fe). The inductors typically have a conductive winding wrapped around the core, which may include, but is not limited to a magnet wire coil that may be flat or rounded, a stamped copper foil, or a clip. The coil may be wound on the drum core or other bobbin core directly. Each end of the winding may be referred to as a lead and is used for coupling the inductor to an electrical circuit. The winding may be preformed, semi-preformed, or non-preformed depending upon the application requirements. Discrete cores may be bound together through an adhesive.

With the trend of power inductors going toward higher current, a need exists for providing inductors having more flexible form factors, more robust configurations, higher power and energy densities, higher efficiencies, and tighter inductance and Direct Current Resistance ("DCR") tolerance. DC to DC converters and Voltage Regulator Modules ("VRM") applications often require inductors having tighter DCR tolerances, which is currently difficult to provide due to the finished goods manufacturing process. Existing solutions for providing higher saturation current and tighter tolerance DCR in typical inductors have become very difficult and costly and do not provide the best performance from these typical inductors. Accordingly, the current inductors are in need for such improvements.

To improve certain inductor characteristics, toroidal cores have recently been manufactured using an amorphous powder material for the core material. Toroidal cores require a coil, or winding, to be wound onto the core directly. During this winding process, the cores may crack very easily, thereby causing the manufacturing process to be difficult and more costly for its use in surface-mount technology. Additionally, due to the uneven coil winding and coil tension variations in toroidal cores, the DCR is not very consistent, which is typically required in DC to DC converters and VRM. Due to the high pressures involved during the pressing process, it has not been possible to manufacture shaped-cores using amorphous powder materials.

Due to advancements in electronic packaging, the trend has been to manufacture power inductors having miniature structures. Thus, the core structure must have lower and lower profiles so that they may be accommodated by the modem electronic devices, some of which may be slim or have a very thin profile. Manufacturing inductors having a low profile has caused manufactures to encounter many difficulties, thereby making the manufacturing process expensive.

For example, as the components become smaller and smaller, difficulty has arisen due to the nature of the components being hand wound. These hand wound components provide for inconsistencies in the product themselves. Another encountered difficulty includes the shaped-cores being very fragile and prone to core cracking throughout the manufacturing process. An additional difficulty is that the inductance is not consistent due to the gap deviation between the two discrete cores, including but not limited to drum cores and shielded cores, ER cores and I cores, and U cores and I cores, during assembly. A further difficulty is that the DCR is not consistent due to uneven winding and tension during the winding process. These difficulties represent examples of just a few of the many difficulties encountered while attempting to manufacture inductors having a miniature structure.

Manufacturing processes for inductors, like other components, have been scrutinized as a way to reduce costs in the highly competitive electronics manufacturing business. Reduction of manufacturing costs is particularly desirable when the components being manufactured are low cost, high volume components. In a high volume component, any reduction in manufacturing cost is, of course, significant. It may be possible that one material used in manufacturing may have a higher cost than another material. However, the overall manufacturing cost may be less by using the more costly material because the reliability and consistency of the product in the manufacturing process is greater than the reliability and consistency of the same product manufactured with the less costly material. Thus, a greater number of actual manufactured products may be sold, rather than being discarded. Additionally, it also is possible that one material used in manufacturing a component may have a higher cost than another material, but the labor savings more than compensates for the increase in material costs. These examples are just a few of the many ways for reducing manufacturing costs.

It has become desirable to provide a magnetic component having a core and winding configuration that can allow one or more of the following improvements, a more flexible form factor, a more robust configuration, a higher power and energy density, a higher efficiency, a wider operating frequency range, a wider operating temperature range, a higher saturation flux density, a higher effective permeability, and a tighter inductance and DCR tolerance, without substantially increasing the size of the components and occupying an undue amount of space, especially when used on circuit board applications. It also has become desirable to provide a magnetic component having a core and winding configuration that can allow low cost manufacturing and achieves more consistent electrical and mechanical properties. Furthermore, it is desirable to provide a magnetic component that tightly controls the DCR over large production lot sizes.

BRIEF DESCRIPTION OF THE DRAWINGS

The foregoing and other features and aspects of the invention will be best understood with reference to the following description of certain exemplary embodiments of the invention, when read in conjunction with the accompanying drawings.

DETAILED DESCRIPTION OF THE INVENTION

Referring to FIGS. 1-5, several views of various illustrative, exemplary embodiments of a magnetic component or device are shown. In an exemplary embodiment the device is an inductor, although it is appreciated that the benefits of the invention described below may accrue to other types of devices. While the materials and techniques described below are believed to be particularly advantageous for the manufacture of low profile inductors, it is recognized that the inductor is but one type of electrical component in which the benefits of the invention may be appreciated. Thus, the description set forth is for illustrative purposes only, and it is contemplated that benefits of the invention accrue to other sizes and types of inductors, as well as other electronic components, including but not limited to transformers. Therefore, practice of the inventive concepts herein is not limited solely to the exemplary embodiments described herein and illustrated in the figures. Additionally, it is understood that the figures are not to scale, and that the thickness and other sizes of the various components have been exaggerated for the purpose of clarity.

Figure 1:
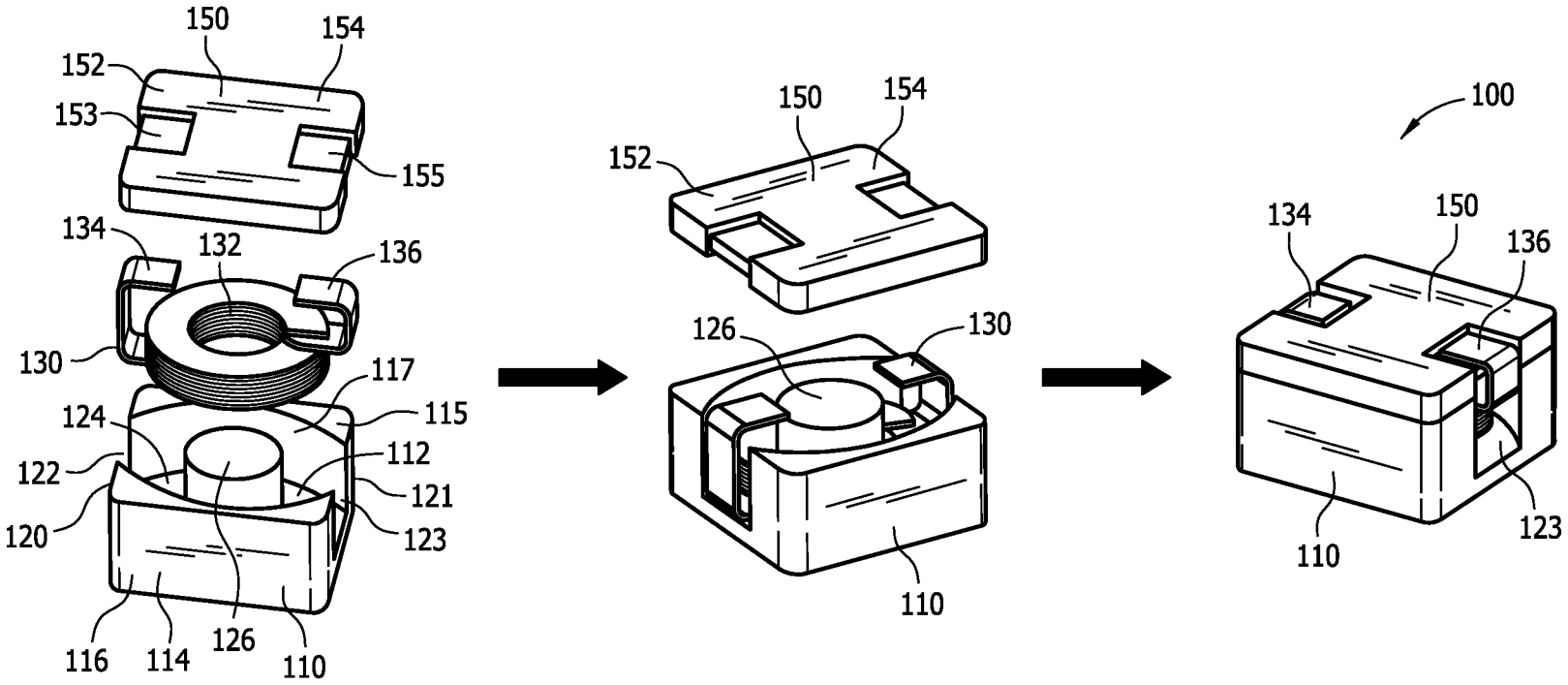
FIG. 1 illustrates a perspective view of a power inductor having an ER-I shaped-core during multiple stages in the manufacturing process, in accordance with an exemplary embodiment.

FIG. 1 illustrates a perspective view of a power inductor having an ER-I shaped-core during multiple stages in the manufacturing process, in accordance with an exemplary embodiment. In this embodiment, the power inductor 100 comprises an ER core 110, a preformed coil 130, and an I core 150.

The ER core 110 is generally square or rectangular in shape and has a base 112, two side walls 114, 115, two end walls 120, 121, a receptacle 124, and a centering projection or post 126. The two side walls 114, 115 extend the entire longitudinal length of the base 112 and have an exterior surface 116 and an interior surface 117, wherein the interior surface 117 is proximate to the centering projection 126. The exterior surface 116 of the two side walls 114, 115 are substantially planar, while the interior surface 117 of the two side walls are concave. The two end walls 120, 121 extend a portion of the width of the base 112 from the ends of each side wall 114, 115 of the base 112, such that a gap 122, 123 is formed in each of the two end walls 120, 121, respectively. This gap 122, 123 may be formed substantially in the center of each of the two end walls 120, 121 such that the two side walls 114, 115 are mirror images of one another. The receptacle 124 is defined by the two side walls 114, 115 and the two end walls 120, 121. The centering projection 126 may be centrally located in the receptacle 124 of the ER core 110 and may extend upwardly from the base 112 of the ER core 110. The centering projection 126 may extend to a height that is substantially the same as the height of the two side walls 114, 115 and the two end walls 120, 121, or the height may extend less than the height of the two side walls 114, 115 and the two end walls 120, 121. As such, the centering projection 126 extends into an inner periphery 132 of the preformed coil 130 to maintain the preformed coil 130 in a fixed, predetermined, and centered position with respect to the ER core 110. Although the ER core is described as having a symmetrical core structure in this embodiment, the ER core may have an asymmetrical core structure without departing from the scope and spirit of the exemplary embodiment.

The preformed coil 130 has a coil having one or more turns, and two terminals 134, 136, or leads, that extend from the preformed coil 130 at 180° from one another. The two terminals 134, 136 extend in an outwardly direction from the preformed coil 130, then in an upward direction, and then back in an inward direction towards the preformed coil 130; thereby each forming a U-shaped configuration. The preformed coil 130 defines the inner periphery 132 of the preformed coil 130. The configuration of the preformed coil 130 is designed to couple the preformed coil 130 to the ER core 110 via the centering projection 126, such that the centering projection 126 extends into the inner periphery 132 of the preformed coil 130. The preformed coil 130 is fabricated from copper and is plated with nickel and tin. Although the preformed coil 130 is made from copper and has nickel and tin plating, other suitable conductive materials, including but not limited to gold plating and soldering, may be utilized in fabricating the preformed coil 130 and/or the two terminals 134, 136 without departing from the scope and spirit of the invention. Additionally, although a preformed coil 130 has been depicted as one type of winding that may be used within this embodiment, other types of windings may be utilized without departing from the scope and spirit of the invention. Additionally, although this embodiment utilizes a preformed coil 130, semi-preformed windings, and non-preformed windings may also be used without departing from the scope and spirit of the invention. Further, although the terminals 134, 136 have been described in a particular configuration, alternative configurations may be used for the terminals without departing from the scope and spirit of the invention. Moreover, the geometry of the preformed coil 130 may be circular, square, rectangular, or any other geometric shape without departing from the scope and spirit of the invention. The interior surface of the two side walls 114, 115 and the two end walls 120, 121 may be reconfigured accordingly to correspond to the geometry of the preformed coil 130, or winding. In the event the coil 130 has multiple turns, insulation between the turns may be required. The insulation may be a coating or other type of insulator that may be placed between the turns.

The I core 150 is generally square or rectangular in shape and substantially corresponds to the footprint of the ER core 110. The I core 150 has two opposing ends 152, 154, wherein each end 152, 154 has a recessed portion 153, 155, respectively, to accommodate an end portion of the terminals 134, 136. The recessed portions 153, 155 are substantially the same width, or slightly larger in width, when compared to the width of the end portion of the terminals 134, 136.

In an exemplary embodiment, the ER core 110 and the I core 150 are both fabricated from an amorphous powder core material. According to some embodiments, the amorphous powder core material can be an iron-based amorphous powder core material. One example of the iron-based amorphous powder core material comprises approximately 80% iron and 20% other elements. According to alternative embodiments, the amorphous powder core material can be a cobalt-based amorphous powder core material. One example of the cobalt-based amorphous powder core material comprises approximately 75% cobalt and 25% other elements. Still, according to some other alternative embodiments, the amorphous powder core material can be a nanoamorphous powder core material.

This material provides for a distributed gap structure, wherein the binder material behaves as gaps within the fabricated iron-based amorphous powder material. An exemplary material is manufactured by Amosense in Seoul, Korea and sold under product number APHxx (Advanced Powder Core), where xx represents the effective permeability of the material. For example, if the effective permeability for the material is 60, the part number is APH60. This material is capable of being used for high current power inductor applications. Additionally, this material may be used with higher operating frequencies, typically in the range of about 1 MHz to about 2 MHz, without producing abnormal heating of the inductor 100. Although the material may be used in the higher frequency range, the material may be used in lower and higher frequency ranges without departing from the scope and spirit of the invention. The amorphous powder core material can provide a higher saturation flux density, a lower hysteresis core loss, a wider operating frequency range, a wider operating temperature range, better heat dissipation and a higher effective permeability. Additionally, this material can provide for a lower loss distributed gap material, which thereby can maximize the power and energy density. Typically, the effective permeability of shaped-cores is not very high due to pressing density concerns. However, use of this material for the shaped-cores can allow a much higher effective permeability than previously available. Alternatively, the nanoamorphous powder material can allow up to three times higher permeability when compared to the permeability of an iron-based amorphous powder material.

As illustrated in FIG. 1, the ER core 110 and the I core 150 are pressed molded from amorphous powder material to form the solid shaped-cores. Upon pressing the ER core 110, the preformed coil 130 is coupled to the ER core 110 in the manner previously described. The terminals 134, 136 of the preformed coil 130 extend through the gaps 122, 123 in the two end walls 120, 121. The I core 150 is then coupled to the ER core 110 and the preformed coil 130 such that the ends of the terminals 134, 136 are coupled within the recessed portions 153, 155, respectively, of the I core 150. The ER core 110, the preformed coil 130, and the I core 150 are then pressed molded together to form the ER-I inductor 100. Although the I core 150 has been illustrated as having recessed portions 153, 155 formed in the two opposing ends 152, 154, the I core 150 may have the recessed portions omitted without departing from the scope and spirit of the invention. Also, although the I core 150 has been illustrated to be symmetrical, asymmetrical I cores may be used, including I cores having mistake proofing, as described below, without departing from the scope and spirit of the invention.

Figure 2:
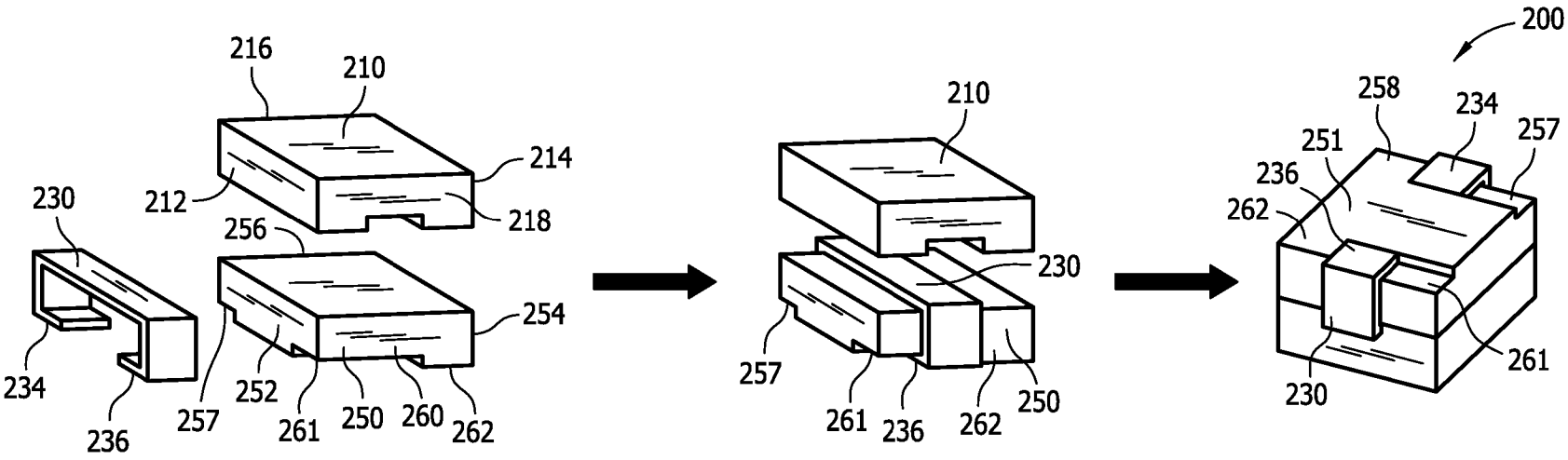
FIG. 2 illustrates a perspective view of an exemplary embodiment of a power inductor having a U-I shaped-core during multiple stages in the manufacturing process, in accordance with an exemplary embodiment.

FIG. 2 illustrates a perspective view of a power inductor having a U-I shaped-core, during multiple stages in the manufacturing process, in accordance with an exemplary embodiment. In this embodiment, the power inductor 200 comprises a U core 210, a preformed clip 230, and an I core 250. As used herein and throughout the specification, the U core 210 has two sides 212, 214 and two ends 216, 218, wherein the two sides 212, 214 are parallel with respect to the orientation of the winding, or clip, 230 and the two ends 216, 218 are perpendicular with respect to the orientation of the winding, or clip 230. Additionally, the I core 250 has two sides 252, 254 and two ends 258, 260, wherein the two sides 252, 254 are parallel with respect to the orientation of the winding, or clip, 230 and the two ends 256, 260 are perpendicular with respect to the orientation of the winding, or clip 230. According to this embodiment, the I core 250 has been modified to provide for a mistake proof I core 250. The mistake proof I core 250 has removed portions 257, 261 from two parallel ends 256, 260, respectively at one side 252 of the bottom 251 of the mistake proof I core 250 and non-removed portions 258, 262 from the same two parallel ends 256, 260, respectively, at the opposing side 254 of the mistake proof I core 250.

The preformed clip 230 has two terminals 234, 236, or leads, that may be coupled around the mistake proof I core 250 by positioning the preformed clip 230 at the removed portions 257, 261 and sliding the preformed clip 230 towards the non-removed portions 258, 262 until the preformed clip 230 may not be moved further. The preformed clip 230 can allow better DCR control, when compared to a non-preformed clip, because bending and cracking of platings is greatly reduced in the manufacturing process. The mistake proof I core 250 enables the preformed clip 230 to be properly positioned so that the U core 210 may be quickly, easily, and correctly coupled to the mistake proof I core 250. As shown in FIG. 2, only the bottom 251 of the mistake proof I core 250 provides the mistake proofing. Although only the bottom 251 of the mistake proof I core 250 provides the mistake proofing in this embodiment, alternative sides, either alone or in combination with another side, may provide the mistake proofing without departing from the scope and spirit of the exemplary embodiment. For example, the mistake proofing may be located only at the opposing ends 256, 260 or at the opposing ends 256, 260 and the bottom 251 of the I core, instead of only at the bottom 251 of the I core 250 as depicted in FIG. 2. Additionally, the I core 250 may be formed without any mistake proofing according some alternative embodiments.

The preformed clip 230 is fabricated from copper and is plated with nickel and tin. Although the preformed clip 230 is made from copper and has nickel and tin plating, other suitable conductive materials, including but not limited to gold plating and soldering, may be utilized in fabricating the preformed clip 230 and/or the two terminals 234, 236 without departing from the scope and spirit of the invention. Additionally, although a preformed clip 230 is used in this embodiment, the clip 230 may be partially preformed or not preformed without departing from the scope and spirit of the invention. Furthermore, although a preformed clip 230 is depicted in this embodiment, any form of winding may be used without departing from the scope and spirit of the invention.

Figure 3B:
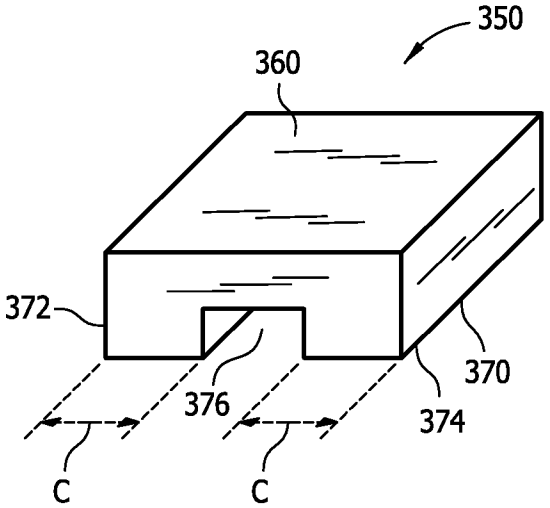
FIG. 3B illustrates a perspective view of an asymmetrical U core in accordance with an exemplary embodiment.
Figure 3A:
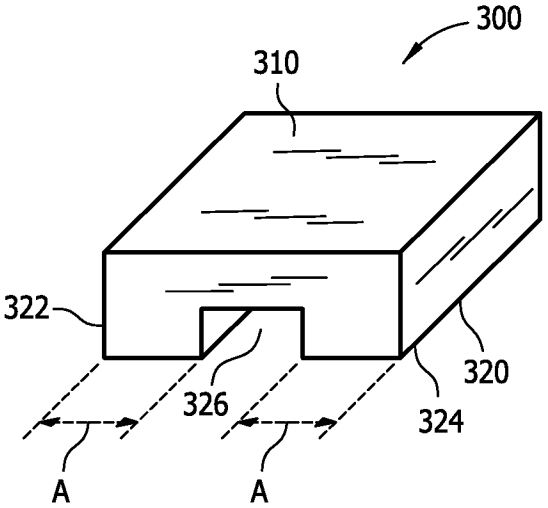
FIG. 3A illustrates a perspective view of a symmetrical U core in accordance with an exemplary embodiment.

The removed portions 257, 261 from the mistake proof I core 250 may be dimensioned such that a symmetrical U core or an asymmetrical U core, which are described with respect to FIG. 3A and FIG. 3B respectively, may be utilized without departing from the scope and spirit of the invention. The U core 210 is dimensioned to have a width substantially the same as the width of the mistake proof I core 250 and a length substantially the same as the length of the mistake proof I core 250. Although the dimensions of the U core 210 have been illustrated above, the dimensions may be altered without departing from the scope and spirit of the invention.

FIG. 3A illustrates a perspective view of a symmetrical U core in accordance with an exemplary embodiment. The symmetrical U core 300 has one surface 310 and an opposing surface 320, wherein the one surface 310 is substantially planar, and the opposing surface 320 has a first leg 322, a second leg 324, and a clip channel 326 defined between the first leg 322 and the second leg 324. In the symmetrical U core 300, the width of the first leg 322 is substantially equal to the width of the second leg 324. This symmetrical U core 300 is coupled to the I core 250, and a portion of the preformed clip 230 is positioned within the clip channel 326. According to certain exemplary embodiments, the terminals 234, 236 of the preformed clip 230 are coupled to the bottom surface 251 of the I core 250. However, in alternative exemplary embodiments, the terminals 234, 236 of the preformed clip 230 may be coupled to the one surface 310 of the U core 300.

FIG. 3B illustrates a perspective view of an asymmetrical U core in accordance with an exemplary embodiment. The asymmetrical U core 350 has one surface 360 and an opposing surface 370, wherein the one surface 360 is substantially planar, and the opposing surface 370 has a first leg 372, a second leg 374, and a clip channel 376 defined between the first leg 372 and the second leg 374. In the asymmetrical U core 350, the width of the first leg 372 is not substantially equal to the width of the second leg 374. This asymmetrical U core 350 is coupled to the I core 250, and a portion of the preformed clip 230 is positioned within the clip channel 376. According to certain exemplary embodiments, the terminals 234, 236 of the preformed clip 230 are coupled to the bottom surface 251 of the I core 250. However, in alternative exemplary embodiments, the terminals 234, 236 of the preformed clip 230 may be coupled to the one surface 360 of the U core 350. One reason for using an asymmetrical U core 350 is to provide a more even flux density distribution throughout the entire magnetic path.

In an exemplary embodiment, the U core 210 and the I core 250 are both fabricated from an amorphous powder core material, which is the same material as described above in reference to the ER core 110 and the I core 150. According to some embodiments, the amorphous powder core material can be an iron-based amorphous powder core material. Additionally, a nanoamorphous powder material may also be used for these core materials. As illustrated in FIG. 2, the preformed clip 230 is coupled to the I core 250, and the U core 210 is coupled to the I core 250 and the preformed clip 230 such that the preformed clip 230 is positioned within the clip channel of the U core 210. The U core 210 can be symmetrical as shown with U core 310 or asymmetrical as shown with U core 350. The U core 210, the preformed clip 230, and the I core 250 are then pressed molded together to form the UI inductor 200. The press molding removes the physical gap that is generally located between the preformed clip 230 and the core 210, 250 by having the cores 210, 250 form molded around the preformed clip 230.

While a power inductor construction has been described including a single pre-formed clip assembled with discrete first and second shaped-core pieces in other embodiments similar benefits may be realized using discrete, shaped-core pieces assembled with more than one pre-formed coil. Additionally, embodiments similar to that shown in FIG. 2 may be fabricated to include a physical gap to provide desirable performance advantages for certain applications and end uses.

Figure 4:
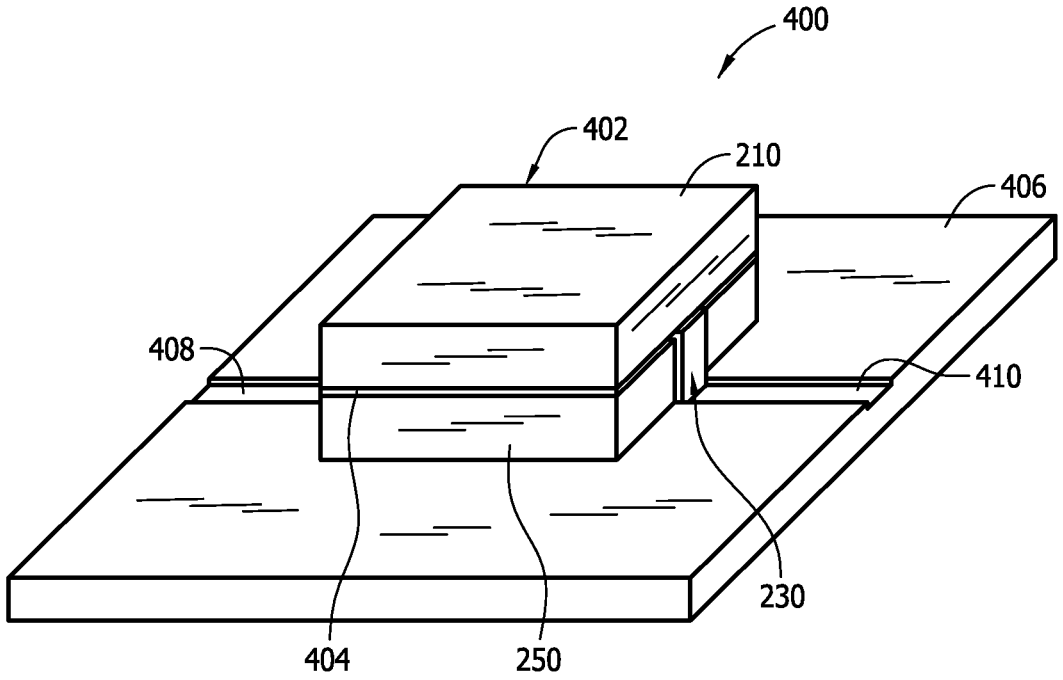
FIG. 4 illustrates a circuit board assembly including a power inductor.

FIG. 4 illustrates a circuit board assembly 400 including a power inductor 402 fabricated similarly to the inductor 200 but assembled to provide a gap 404 between the U core 210 and the I core 250. Of course, the gap 404 need not be included in all embodiments, and if the gap 404 were not formed the power inductor 402 would be the same as the inductor 200 described above.

The power inductor 402, as shown in FIG. 4, is mounted to a circuit board 406 including circuitry that is partially shown to include circuit traces 408, 410. The terminals 234, 236 (FIG. 2) of the preformed clip 230 are soldered to the respective circuit traces 408, 410 to complete an electrical connection through the inductor 402. Typically, the terminals 234, 236, of the preformed clip 230 are soldered to the surface of the board 406, but the core piece 250 that faces the board 406 is not.

In an exemplary embodiment, the power inductor 402 and board 406 are adapted for a power supply management application. That is, the circuitry on the board 406 may include power management circuitry for powering an electronic device, including but not necessarily limited to a handheld electronic device. The power inductor 402 operates to induce a magnetic field via current flowing through the preformed clip 230, and stores energy via the generation of the magnetic field in the core pieces 210 and 250. The power inductor 402 also returns the stored energy to the electrical circuitry on the board 406 as the current through the preformed clip 230 falls. The power inductor 402 may, for example, provide regulated power from rapidly switching power supplies. Multiple inductors 402 may be provided on the board 406 to implement the power supply management circuitry to the same or different electrical loads.

Figure 5:
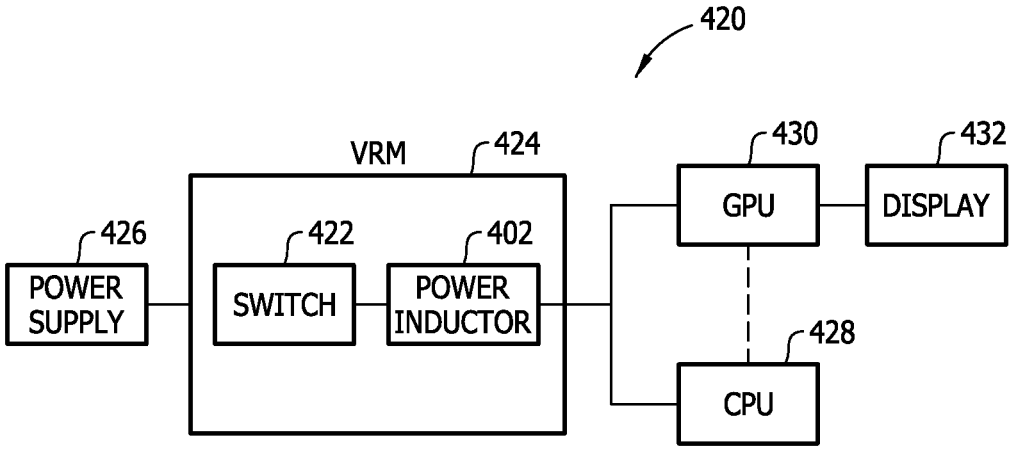
FIG. 5 schematically illustrates electronic circuitry including the power inductor shown in FIG. 4.

FIG. 5 schematically illustrates a part of power supply management circuitry 420 that in one embodiment may be implemented with the circuitry on the board 406. As shown in FIG. 5, the power inductor 402 is connected to a switching element 422 in a voltage regulator module 424. The voltage regulator module 424 receives electrical power from a power supply 426, and among other things, rapidly switches the input power form the power supply 426 to the power inductor 402. That is, the switching element 422 rapidly connects and disconnects the power inductor 402 to and from the power supply 426.

When the power inductor 402 is connected with the switching element 422 closed, electrical current flows through the preformed clip 230, a magnetic field is induced, and electrical energy is stored in the magnetic core (i.e., in the magnetic core pieces 210, 250 that are assembled with the preformed clip 230. When the power inductor 402 is disconnected with the switching element 422 opened, the stored energy in the power inductor 402 is returned to the circuitry. The power inductor 402 is connected to a central processing unit (CPU) 428 and/or a graphic processing unit (GPU) 430, which in turn is connected to a display 432 of the electronic device.

In such an arrangement, the electrical current demand from the CPU 428 and GPU 430 are normally not a constant. Instead, the CPU 428 and GPU 430 load is dynamic and the dynamic load change can be at a fixed frequency or variable frequencies. The fixed or variable frequencies can be located in the audible ranges such as from 20 Hz to 20 kHz. The switching mode power supply or the voltage regulation module 424, which is designed to provide power to the GPU 430 and CPU 428, will need to provide a variable current to follow the GPU 430 and CPU 428 dynamic load changes, hence the power inductor(s) 402 in the switching mode power supply 424 experience a high-to-low or low-to-high current transition. This low-to-high and high-to-low current transition in the power inductor 402 causes acoustic noises and these noises could be in the audible ranges. Especially when a number of power inductors 402 are used in combination in such circuitry 420, the acoustic noise produced is undesirable.

It has been discovered that the source of some of the undesirable acoustic noise of the power inductor 402 in the circuitry 420 stems from an unbalanced force in the power inductor 402, and specifically between the core pieces 210, 250 and the preformed clip 230 in use. Since the preformed clip 230 is normally soldered on the printed circuit broad 406 and the core pieces 210, 250 are not, the unbalanced force causes vibration that can be in the audible, acoustic range.

Exemplary embodiments of power inductors are accordingly described below that address such vibration and associated acoustic noise issues of the power inductors in an application such as the circuitry 420. It is understood, however, that the vibration and acoustic noise issue is not necessarily unique to circuitry 420 and that other applications can likewise benefit from the power inductor constructions described below. Method aspects will be in part explicit and in part apparent from the following description.

Figure 6:
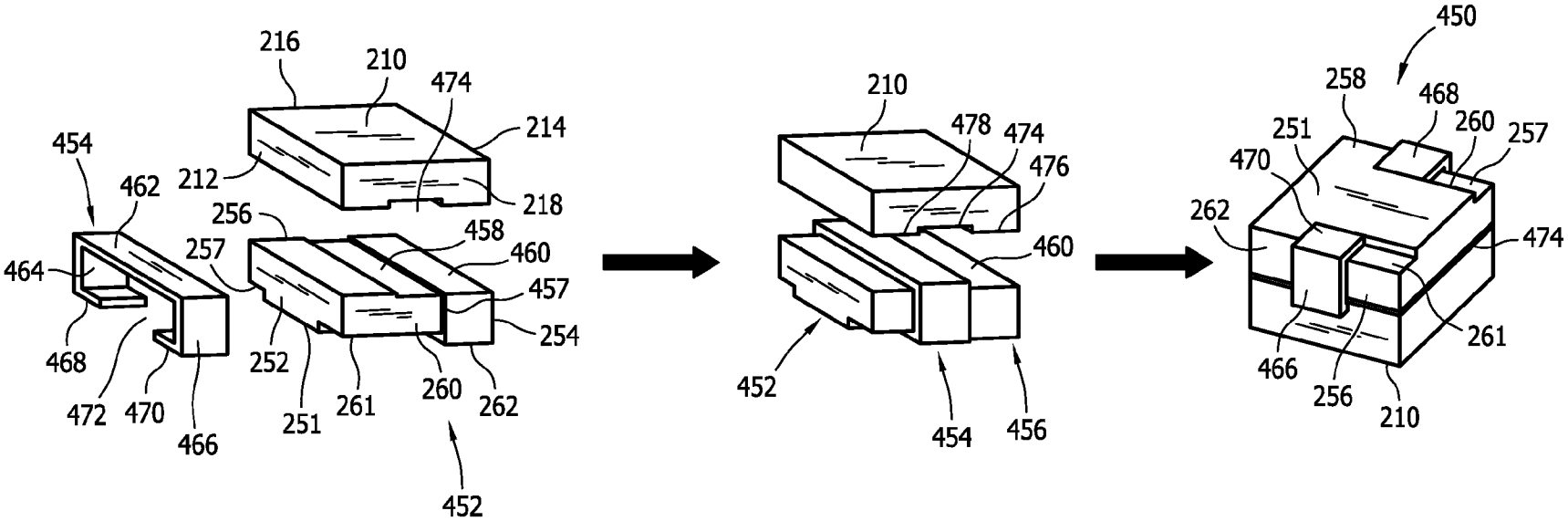
FIG. 6 illustrates a perspective view of another exemplary embodiment of a power inductor having a U-I shaped-core during multiple stages in the manufacturing process.
Figure 7:
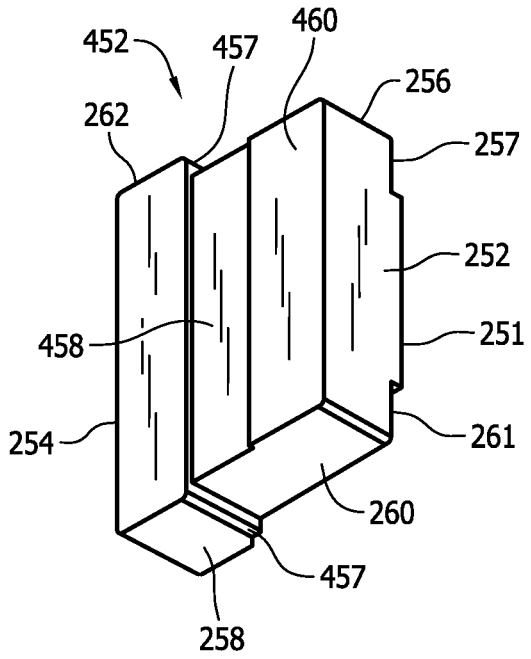
FIG. 7 is a perspective view of the I-shaped core shown in FIG. 6.

FIG. 6 illustrates a magnetic power inductor component 450 in various stages of manufacture. As shown in FIG. 6, the power inductor 450 includes a first magnetic core piece 452 and a winding 454 forming a first subassembly 456.

In the exemplary embodiment shown, the magnetic core piece 452 is an I Core similar to the core 250 described above. As shown in FIGS. 6-9, the core piece 452 is shaped to generally include parallel sides 252, 254 and ends 256, 260 interconnecting the parallel sides 252, 254. The ends 256, 260 extend parallel to one another and perpendicular to the parallel sides 252, 254 to impart an orthogonal arrangement of the sides 252, 256, 254, 260.

Like the core piece 250, removed portions 257, 261 extend as recesses from the respective parallel ends 256, 260 on the bottom side 251 of the core piece 452. The recesses 257, 261 extend from the side 252 to non-removed or non-recessed side surfaces 258, 262 from the same two parallel ends 256, 260, respectively, adjacent the opposing side 254.

Figure 8:
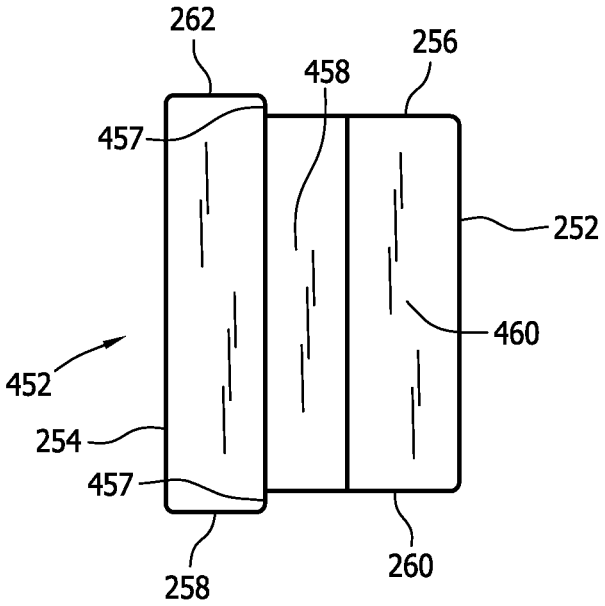
FIG. 8 is a top view of the I-shaped core shown in FIG. 7.
Figure 9:
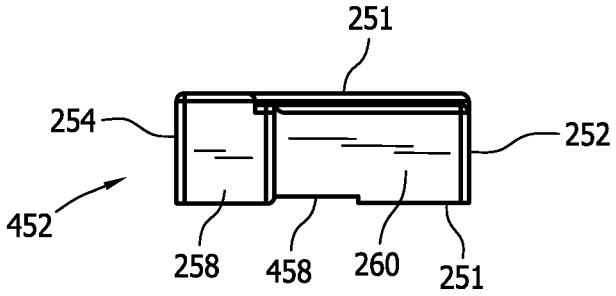
FIG. 9 is an end view of the I-shaped core shown in FIG. 7.

As best seen in the top view of FIG. 8, the opposing sides 252, 254 extend continuously in a straight and parallel orientation to one another, while the opposing ends 256 and 260 include discontinuities where the respective recessed or removed portions 257, 261 meet the non-recessed or non-removed portions of the side surfaces 258, 262. Specifically, the respective recessed or removed portions 257, 261 extend from the side 252 to perpendicular ledges 457 that extend outwardly to the non-recessed or non-removed portions of the side surfaces 258, 262. The non-recessed or non-removed portions of the side surfaces 258, 262 extend between the perpendicular ledges 457 and the side 254. The recessed or removed portions 257, 261, the non-recessed or non-removed portions of the side surfaces 258, 262, and the ledges 457 define stepped side surfaces extending between the opposing ends 252, 254 that are oriented in an inverted or mirror-image arrangement to one another. From the top view of FIG. 8, the outer profile of the core piece 452 is generally rectangular with the stepped side surfaces interconnecting a long side 254 and a shorter side 252 opposing the long side. The difference in length between the long side 254 and the short side 252 is about equal to the combined length of the ledges 457 extending between the recessed or removed portions 257, 261 and the non-recessed or non-removed portions of the side surfaces 258, 262.

Unlike the core 250 that includes a flat or planar and continuous upper surface as shown in FIG. 2, the core piece 452 includes a groove 458 on an upper surface 460 thereof. The groove 458 as shown extends linearly across the entire top surface 460 in a direction generally perpendicular to the sides 256, 260 of the core piece 452 and generally parallel to the sides 252, 254. In other words, the groove 458 has side edges that extend parallel to the sides 252, 254, and the groove 458 is generally centered between the sides 252, 254. One of the side edges of the groove 458 coincides with the ledges 457. The groove 458 defines a notch or recessed surface having a depth measured from the upper or top surface 460. The depth of the groove 458 may vary in different embodiments, and in contemplated embodiments the groove 458 may vary from about 0.1 mm to about 0.5 mm. As explained below, the groove 458 defines a seating surface for the winding 454 so that it can be positioned to substantially balance the force between the core pieces and the preformed clip 454 for the power inductor 450 in use. In other words, the depth of the groove can be strategically selected to minimize any unbalance of force that may otherwise exist for the component 450 in use.

The magnetic core piece 452 may be fabricated from any of the magnetic materials described above and associated techniques, or alternatively may be fabricated from other suitable materials and techniques known in the art to produce the shaped core piece 452 as described.

Also in the exemplary embodiment shown in FIG. 6, the winding 454 is provided in the form of a pre-formed winding clip having an elongated, generally flat and planar main winding section 462 and opposing leg sections 464 and 466 extending from either end of the main winding section 462. The legs 464 and 466 extend generally perpendicularly from the plane of the main winding section 462 in a substantially C-shaped arrangement. The pre-formed winding clip 454 further includes terminal lead sections 468, 470 extending from each of the respective legs 464 and 466 and toward one another. The terminal lead sections 468, 470 extend generally perpendicular to the respective planes of the legs 464 and 466 and generally parallel to a plane of the main winding section 462. The terminal lead sections 468, 470 provide spaced apart contact pads for surface mounting to a circuit board (not shown). The clip 454 and its sections 462, 464, 466, 468 and 470 collectively form a body or frame defining an interior region or cavity 472. In the exemplary embodiment shown, the cavity 472 is substantially rectangular and complementary in shape to the leading end 252 of the first magnetic core piece 452.

In exemplary embodiments, the clip 454 may be fabricated from a sheet of copper or other conductive material or alloy and may be formed into the shape as shown using known techniques, including but not limited to stamping and pressing techniques. In an exemplary embodiment, the clip 454 is separately fabricated and provided for assembly to the core piece 452, referred to here as being a pre-formed coil 454. Such a pre-formed coil 454 is specifically contrasted with conventional magnetic component assemblies wherein the coil is formed about a core piece, or otherwise is bent or shaped around a core piece.

As shown in FIG. 6 the clip 454 and the first magnetic core piece 452 are assembled or otherwise coupled to one another to form a first subassembly 456. In one embodiment the core piece 452 could be fabricated independently from the clip 454 and the core piece 452 is fitted into the cavity 472 of the clip 454 to complete the subassembly with, for example, sliding engagement. When assembled, the main winding section 462 of the clip 454 seats in the groove 458 in the top surface 460 of the core piece 452 and the clip 454 is adjacent to the ledges 457. As shown, the two sides 252, 254 of the core piece 452 extend parallel to the main winding section 462 of the clip 454, and the side edges of the groove 458 are spaced apart by a distance about equal to the spaced apart side edges of the main winding section 462. The legs 464, 466 of the winding clip 454 extend around the sides 256, 260 of the core piece 452, and the terminal lead sections 468, 470 extend alongside the bottom surface 251 of the core piece 452.

The assembly 456 may then be assembled with the U-shaped core piece 210 described above. The core piece 210 is fitted over the top surface 460 of the core piece 452 and the main winding section 462 of the coil 454. In one embodiment, the depth of the groove 458 in the core piece 452 may be selected to be about equal to the corresponding depth of the clip channel 474 extending between opposed legs 476, 478 of the U-shaped core piece 210. In other embodiment, the clip channel 474 in the core piece 210 may have a different depth than the groove 458 in the core piece 452. Optionally, a physical gap 474 is established between the core pieces 452, 210.

By seating the main winding section 462 of the preformed clip 454 in the groove 458 in the core piece 452, the location of the clip 454 is slightly changed in the assembled component 450 as compared to an otherwise similar power inductor such as the power inductor 200 that does not include the groove 458. By varying the depth of the groove 458 and the location of the clip main winding section 462 when seated therein, any unbalanced force that may otherwise exist between the core pieces 452, 210 and the winding clip 454 may be minimized, if not entirely eliminated. As the unbalanced force is driven toward zero, vibration and related acoustic noise issues of the component 450 in operation are likewise reduced.

While a single coil embodiment has been described in relation to FIGS. 6-9, it is recognized that multiple coil embodiments are possible in further and/or alternative embodiments. That is, the core pieces 452 and 210 may be configured for assembly with more than one coil 454 with substantially similar benefits.

Figure 10:
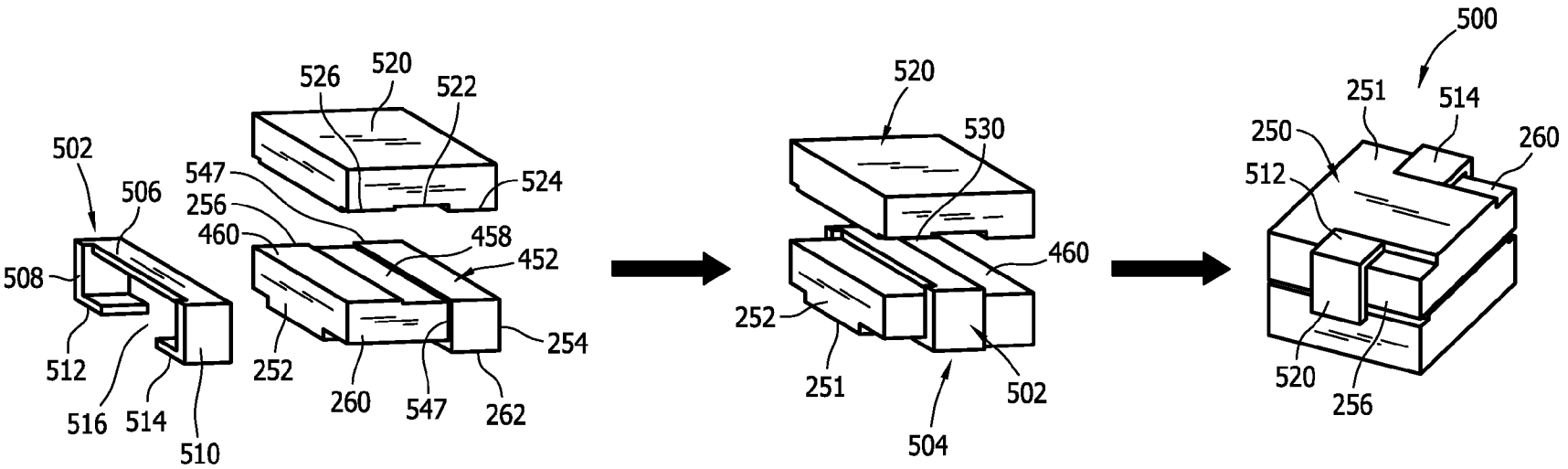
FIG. 10 illustrates a perspective view of another exemplary embodiment of a power inductor having a U-I shaped-core during multiple stages in the manufacturing process.

FIG. 10 illustrates another magnetic power inductor component 500 in various stages of manufacture. The power inductor 500 includes the core piece 452 as described above, and a winding 502 forming a first subassembly 504.

The winding 502 is provided in the form of a pre-formed winding clip having an elongated, generally flat and planar main winding section 506 and opposing leg sections 508 and 510 extending from either end of the main winding section 506. The legs 508 and 510 extend generally perpendicularly from the plane of the main winding section 506 in a substantially C-shaped arrangement. The pre-formed winding clip 502 further includes terminal lead sections 512, 514 extending from each of the respective legs 508 and 510. The terminal lead sections 512, 514 extend generally perpendicular to the respective planes of the legs 508 and 510 and generally parallel to a plane of the main winding section 506. The terminal lead sections 512, 514 provide spaced apart contact pads for surface mounting to a circuit board (not shown). The clip 502 and its sections 506, 508, 510, 512, 514 collectively form a body or frame defining an interior region or cavity 516. In the exemplary embodiment shown, the cavity 516 is substantially rectangular and complementary in shape to the leading end 252 of the first magnetic core piece 250.

In exemplary embodiments, the clip 502 may be fabricated from a sheet of copper or other conductive material or alloy and may be formed into the shape as shown using known techniques, including but not limited to stamping and pressing techniques. In an exemplary embodiment, the clip 502 is separately fabricated and provided for assembly to the core piece 250, referred to here as being a pre-formed coil 502. Such a pre-formed coil 502 is specifically contrasted with conventional magnetic component assemblies wherein the coil is formed about a core piece, or otherwise is bent or shaped around a core piece.

Unlike the clip 454, the sections 506, 508, 510, 512, 514 do not have an equal lateral dimension measured in a directional perpendicular to an axis of the main winding section 506. In the embodiment depicted in FIG. 10, the legs 508 and 510 and the lead terminals 512 and 514 are respectively wider than the main winding section 506 of the clip 502. The wider legs 508 and 510 and the lead terminals 512 and 514 therefore define a larger cross sectional area than the main winding section 506. Also, the wider legs 508 and 510 and the lead terminals 512 and 514 provides larger surface area for assembly of the component and surface mounting to a printed circuit board to facilitate the assembly and installation of a miniaturized power inductor 500. The wider cross section and surface areas of the leg sections 508, 510 and the terminal lead sections 512, 514 may also reduce the direct current resistance (DCR) of the power inductor 500 in use.

As shown in FIG. 10 the clip 502 and the first magnetic core piece 452 are assembled or otherwise coupled to one another to form a first subassembly 504. In one embodiment the core piece 452 could be fabricated independently from the clip 502 and the core piece 452 is fitted into the cavity 516 of the clip 502 to complete the subassembly with, for example, sliding engagement. As shown, the two sides 252, 254 of the core piece 452 extend parallel to the main winding section 506 of the clip 502. The legs 508, 510 of the winding clip 502 extend around the sides 256, 260 of the core piece 452, and the terminal lead sections 512, 514 extend alongside the bottom surface 251 of the core piece 452. The main winding section 506 of the clip 502 seats in the groove 458 in the top surface 460 of the core piece 452 and the clip 454 is adjacent to the ledges 457. As shown, the two sides 252, 254 of the core piece 452 extend parallel to the main winding section 506 of the clip 502, and the side edges of the groove 458 are spaced apart by a distance about equal to the spaced apart side edges of the main winding section 506.

The assembly 504 may then be assembled with a U-shaped core piece 520. The core piece 520 is fitted over the top surface of the core piece 250 the main winding section 506 of the coil 502. The main winding section 506 of the winding clip 502 is accommodated by a clip channel 522 extending between opposed legs 524 and 526 of the core piece 520. Optionally, a physical gap may be established between the core pieces 520 and 250.

Figure 11:
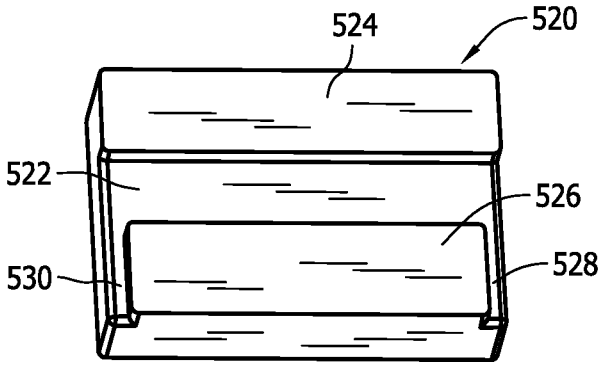
FIG. 11 is a perspective view of the U-shaped core shown in FIG. 11.

Because the main winding section 506 of the winding clip 502 is not as wide as the legs 508, 510, the core piece 520 further includes, as best shown in FIG. 11 in top perspective view, removed portions 528, 530 extending on either end of the leg 526. The removed portions 528, 530 define clearance areas to accommodate the wider legs 508, 510 of the winding clip 502 when the main winding section 506 is extended in the clip channel 522. The leg 524, which does not include removed portions, is longer than the leg 528 such that the core piece 520 is asymmetrical.

Figure 12:
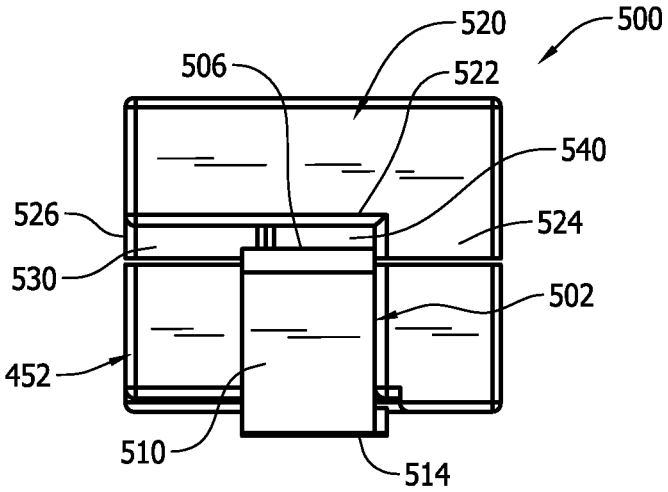
FIG. 12 is a first end view of the assembled component power inductor shown in FIG. 10.

FIG. 12 is an end view of the assembled power inductor 500. The main winding section 506 of the winding clip 502 extends in the groove 518 in the core piece 452, and also extends in the clip channel 522 of the core piece 520. Optionally, a physical gap or clearance 524 is established between the top of the main winding section 506 and the bottom of the clip channel 522. The wider leg 510 is seen to occupy part of the recess 530 in the core piece 520.

Figure 13:
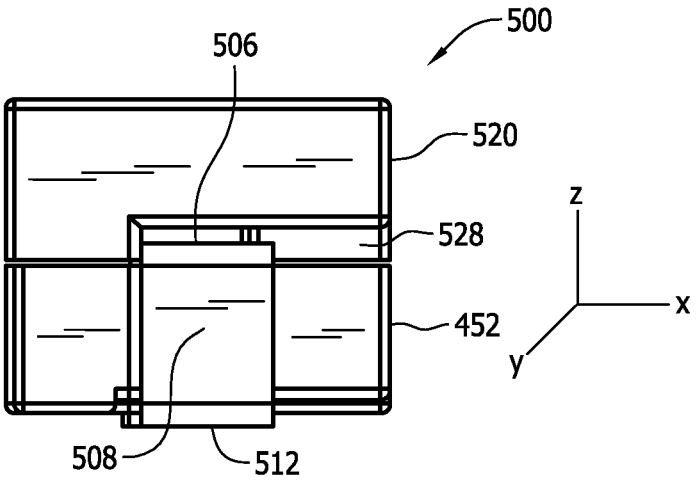
FIG. 13 is a second end view of the assembled component shown in FIG. 10.

FIG. 13 is another end view of the assembled power inductor 500. The main winding section 506 of the winding clip 502 extends in the groove 518 in the core piece 452, and also extends in the clip channel 522 of the core piece 520. The wider leg 510 is seen to occupy part of the recess 528 in the core piece 520.

By seating the main winding section 506 of the preformed clip 502 in the groove 458 in the core piece 452, the location of the clip 502 is slightly changed in the assembled component 500 relative to a similar component that does not include the groove 458. By varying the depth of the groove 458 and the location of the main winding section 506 of the winding clip 502 when seated in the groove 458, any unbalanced force that may otherwise exist between the core pieces 452, 520 and the winding clip 502 may be minimized, and accordingly vibration of the power inductor in use may be reduced. As the unbalanced force is driven toward zero, vibration and associated acoustic noise issues of the component 500 in operation are reduced.

Table 1 below illustrates a comparison of the force experience on the clip 502 in the embodiment of FIGS. 10-13 in use in the application discussed above in relation to FIG. 5. The forces can be calculated along the x, y, and z axes shown in FIG. 14 using known techniques. In Table 1, Inductor 1 does not include the groove 458 in the piece 452 and instead includes a flat upper surface, while Inductor 2 includes the groove 458 having an exemplary depth of 0.3 mm.

TABLE 1

| | | force on the clip (mNewton) | | |
|---|---|---|---|---|
| Inductors | I CORE | Fx | Fy | Fz |
| Inductor 1 | No groove on the I core | −0.25831 | −0.88947 | 0.001172 |
| Inductor 2 | A 0.3 mm depth groove on the I core | 0.0125 | −0.0232 | 0.00082 |

It should be evident from Table 1 that the unbalanced force on the clip on Inductor 2 including the groove is essentially negligible and acoustic noise associated with the force is accordingly reduced.

Table 2 below illustrates noise measurements on samples of Inductors 1 and 2 referenced in Table 1. The values of Table 2 shown noise measurements measured in decibels (dB).

TABLE 2

| sample # | Inductor 1 | Inductor 2 |
|---|---|---|
| 1 | 52.1 | 46.6 |
| 2 | 49.1 | 46.3 |
| 3 | 52.4 | 48.8 |
| 4 | 53.2 | 50 |
| 5 | 55.4 | 49.3 |
| average | 52.44 | 48.2 |

It should be evident from Table 2 that significant acoustic noise reduction is seen in the Inductor 2 components. An average drop of 4.24 dB is seen between inductors with and without the groove 458. For reference, a 5 dB noise reduction represents a reduction of 50% of the acoustical energy produced by a noise source.

While a single coil embodiment has been described in relation to FIGS. 10-13, it is recognized that multiple coil embodiments are possible in further and/or alternative embodiments. That is, the core pieces 452 and 210 may be configured for assembly with more than one coil 454 with substantially similar benefits.

Figure 14:
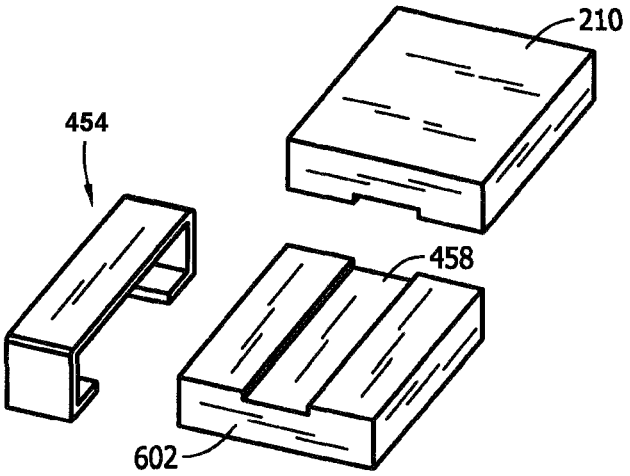
FIG. 14 is a perspective assembly view of another embodiment of a power inductor including first and second shaped cores.
Figure 15:
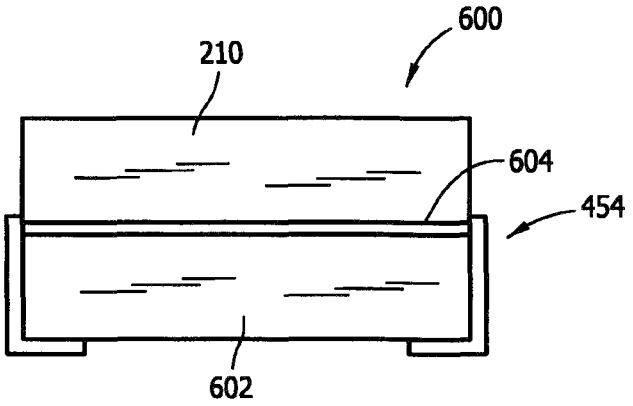
FIG. 15 is a first end view of the power inductor shown in FIG. 14 after assembly.
Figure 16:
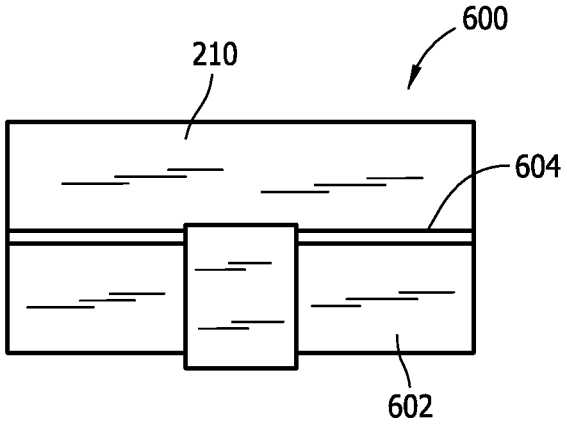
FIG. 16 is a second end view of the power inductor shown in FIG. 15.

FIGS. 14-16 illustrate another power inductor 600 at various stages of manufacture. The power inductor 600 includes the winding clip 454, a core piece 602 and the core piece 210. The core piece 602 includes the groove 458, but none of the removed portions of the core piece 452. As such, the core 602 resembles the U-shaped core 210.

The clip 454 is assembled with the core pieces 602 and 210 such that the main winding section of the clip 454 extends in the groove 458 and is accommodated by the clip channel of the core piece 210. Optionally, a physical gap 604 is established between the core pieces as shown in the assembled power inductor of FIGS. 15 and 16. By virtue of the groove 458, vibration and acoustic noise issues that otherwise may exist are reduced.

The power inductors 450, 500, 600 may be mounted to the circuit board 406 (FIG. 4) in lieu of the power inductor 402. The power inductors 450, 500, 600 may be surface mounted to the circuit board 406 to complete an electrical connection between the circuit traces 408, 410 on the board 406. In contemplated embodiments, the terminal lead sections of the preformed winding clips of the power inductors 450, 500, 600 may be soldered to the surface of the board 406, without soldering the core-pieces including the surface mount terminal lead sections to the board. In other words, the preformed winding clip is contemplated to be soldered to the board, but the lower core piece facing the board is not. The circuitry on the board may correspond to the circuitry 420 described in relation to FIG. 5, and the power inductors 450, 500, 600 may operate with substantial reduction in acoustic noise.

The benefits and advantages of the present invention are now believed to have been amply illustrated in relation to the exemplary embodiments disclosed.

An embodiment of a surface mount power inductor has been disclosed, including: a first shaped-core piece and a second shaped-core piece each fabricated from a magnetically soft powder material, the first shaped-core piece and the second shaped-core piece being separately and independently fabricated from one another; a preformed C-shaped conductive winding clip separately fabricated from either of the first shaped-core piece and the second shaped-core piece; wherein the winding clip includes a main winding section, first and second legs extending from opposing ends of the main winding section, and first and second terminal lead sections extending from the respective first and second legs; wherein the preformed C-shaped conductive winding clip is coupled to the first shaped-core piece without bending any portion of the winding clip around the first shaped-core; wherein the second shaped-core piece is coupled to the first shaped-core piece to complete the power inductor; and wherein the main winding section of the preformed C-shaped conductive winding clip extends between the first shaped core and the second shaped core.

Optionally, the magnetically soft powder material is a nanoamorphous powder material The magnetically soft powder material may be an iron-based amorphous powder material. One of the first and second shaped-core pieces may be formed with a groove, and the main winding section may be extended in the groove. One of the first and second shaped-core pieces may be a U core. One of the first and second shaped-core pieces may be an I core.

As other options, the first shaped-core piece is formed with a groove, and the main winding section may be seated in the groove. The first core piece may include a top surface and a bottom surface, the bottom surface further having a first end, the bottom surface configured to receive the first and second terminal lead sections at the first end and allow the main winding section to be laterally moved across the top surface and away from the first end until the first and second terminal lead sections reach a predetermined position on the bottom surface, and the bottom surface is further configured to prevent movement of the first and second terminal lead sections beyond the predetermined position. The first-shaped core piece may include opposing first and second sides, each of the first and second sides having a stepped surface, and stepped surface of the first side being inverted relative to the stepped surface of the second side. The stepped surfaces of each of the first and second sides may include a ledge, and an edge of the groove may coincide with the ledge. The groove may have a depth of about 0.1 mm to about 0.5 mm. The groove may have a depth of about 0.3 mm. The second shaped-core may be formed to include a clip channel, the clip channel having a depth, and the depth of the groove of the first shaped-core piece may be equal to the depth of the clip channel in the second shaped-core piece.

The second shaped-core element may be formed to include a first leg, a second leg, and a clip channel extending between the first and second leg sections. The first leg may have a different length than the second leg. The main winding section of the preformed C-shaped conductive winding clip may have a first width, and the first and second legs of the preformed C-shaped conductive winding clip have a second width, the first and second width being different from one another. The second width may be greater than the first width.

Each of the first and second shaped-core pieces may be asymmetrical. A physical gap may be established between the first shaped-core piece and the second shaped-core piece. At least one of the first and second shaped-core pieces may be formed with a groove, the groove having a depth selected to reduce an unbalanced force in the power inductor when used. The main winding section of the preformed C-shaped conductive winding clip may have a first width, and the first and second legs of the preformed C-shaped conductive winding clip may have a second width, the first and second width being different from one another.

The first shaped-core piece may be formed with a groove, the groove having a width equal to the width of the main winding section. The second shaped-core piece is formed with a clip channel, the clip channel having a width equal to the width of the main winding section.

The first and second shaped-cores may be pressed in surface contact with one another.

The main winding section of the preformed C-shaped conductive winding clip may have a first width, and wherein the first and second legs and the first and second terminal lead sections of the preformed C-shaped conductive winding clip have a second width, the first and second width being different from one another. The second width is greater than the first width.

The first shaped-core piece may be formed with a groove, the main winding section seated in the groove and the groove having a depth selected to reduce an acoustic noise while the power inductor is operating in an electrical circuit. The groove may have a depth from about 0.1 mm to about 0.5 mm. The groove may have depth of about 0.3 mm. The groove may have a depth selected to reduce the acoustic noise by about 4 dB. The power inductor may be operable with acoustic noise in a range of about 46 dB to about 49 dB in a power supply management circuit. The power inductor of claim 31 may be operable with acoustic noise of about 48 dB in the power supply management circuit.

The electrical circuit may be a power supply management circuit wherein the power inductor experiences a high-to-low or low-to-high current transition in the electrical circuit. The surface mount power inductor may be in combination with a circuit board configured to implement power supply management circuitry. The power supply management circuitry may supply power to a dynamic load. The load may include one of a CPU and a GPU. The terminal lead sections may be soldered to the board but the first core piece is not.

The first shaped-core piece may have a different shape than the second shaped-core piece. The first shaped-core piece may have opposing first and second ends, wherein the first end is longer than the second end. The first shaped-core piece may include opposing stepped side surfaces extending between the first and second ends. The first shaped-core piece may include an upper surface and a groove formed in the upper surface between the opposing stepped side surfaces. The main winding section of the pre-formed clip may be seated in the groove. The groove may have a depth of about 0.1 mm to about 0.5 mm. The groove may have a depth of about 0.3 mm.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A surface mount power inductor, comprising:

a first shaped-core piece and a second shaped-core piece each fabricated from a magnetically soft powder material, the first shaped-core piece and the second shaped-core piece being separately and independently fabricated from one another;

a preformed C-shaped conductive winding clip separately fabricated from either of the first shaped-core piece and the second shaped-core piece;

wherein the winding clip includes a main winding section, first and second legs extending from opposing ends of the main winding section, and first and second terminal lead sections extending from the respective first and second legs;

wherein the first shaped-core piece is asymmetrical and includes a bottom surface defined by opposing first and second side edges and opposing first and second end edges interconnecting the first and second side edges, wherein the first end edge is longer than the second end edge, the first and second side edges include a respective first and second recess, and the first shaped-core piece further including an upper surface and groove in the upper surface;

wherein the preformed C-shaped conductive winding clip is coupled to the first shaped-core piece without bending any portion of the winding clip around the first shaped-core piece and the first and second terminal lead sections being received in the respective first and second recess;

wherein the second shaped-core piece is coupled to the first shaped-core piece to complete the power inductor; and wherein the main winding section of the preformed C-shaped conductive winding clip extends between the first shaped-core piece and the second shaped-core piece.

2. The surface mount power inductor of claim 1, wherein the magnetically soft powder material is a nanoamorphous powder material.

3. The surface mount power inductor of claim 1, wherein the magnetically soft powder material is an iron-based amorphous powder material.

4. The surface mount power inductor of claim 1, wherein one of the first and second shaped-core pieces is a U core.

5. The surface mount power inductor of claim 1, wherein one of the first and second shaped-core pieces is an I core.

6. The surface mount power inductor of claim 1, wherein the main winding section of the preformed C-shaped conductive winding clip is seated in the groove.

7. The surface mount power inductor of claim 1, wherein the first and second recesses extend only to one of the first and second end edges of the first shaped-core piece.

8. The surface mount power inductor of claim 1, wherein the main winding section of the preformed C-shaped conductive winding clip is spaced from each of the opposing first and second end edges of the first shaped-core piece.

9. The surface mount power inductor of claim 1, wherein the upper surface of the first shaped-core piece includes a ledge, and an edge of the groove coincides with the ledge.

10. The surface mount power inductor of claim 1, wherein the groove of the first shaped-core piece has a depth of about 0.1 mm to about 0.5 mm.

11. The surface mount power inductor of claim 10, wherein the groove has a depth of about 0.3 mm.

12. The surface mount power inductor of claim 1, wherein the second shaped-core piece includes a clip channel, the clip channel having a depth.

13. The surface mount power inductor of claim 12, wherein the depth of the groove of the first shaped-core piece is equal to the depth of the clip channel in the second shaped-core piece.

14. The surface mount power inductor of claim 1, wherein the second shaped-core piece is formed to include a first leg, a second leg, and a clip channel extending between the first and second leg sections.

15. The surface mount power inductor of claim 14, wherein the first leg has a different length than the second leg.

16. The surface mount power inductor of claim 15, wherein the main winding section of the preformed C-shaped conductive winding clip has a first width, and the first and second legs of the preformed C-shaped conductive winding clip have a second width, the first and second width being different from one another.

17. The surface mount power inductor of claim 16, wherein the second width is greater than the first width.

18. The surface mount power inductor of claim 1, wherein the second shaped-core piece are is asymmetrical.

19. The surface mount power inductor of claim 1, wherein a physical gap is established between the first shaped-core piece and the second shaped-core piece.

20. The surface mount power inductor of claim 1, wherein the groove has a depth selected to reduce an unbalanced force in the power inductor when used.

21. The surface mount power inductor of claim 20, wherein the main winding section of the preformed C-shaped conductive winding clip has a first width, and the first and second legs of the preformed C-shaped conductive winding clip have a second width, the first and second width being different from one another.

22. The surface mount power inductor of claim 20, wherein the main winding section of the preformed C-shaped conductive winding clip has a first width, and wherein, the groove of the first shaped-core piece has a width equal to the first width of the main winding section.

23. The surface mount power inductor of claim 20, wherein the main winding section of the preformed C-shaped conductive winding clip has a first width, and wherein the second shaped-core piece is formed with a clip channel, the clip channel having a width equal to the first width of the main winding section.

24. The surface mount power inductor of claim 1, wherein at least a portion of the first and second shaped-core pieces are pressed in surface contact with one another.

25. The surface mount power inductor of claim 1, wherein the main winding section of the preformed C-shaped conductive winding clip has a first width, and wherein the first and second legs and the first and second terminal lead sections of the preformed C-shaped conductive winding clip have a second width, the first and second width being different from one another.

26. The surface mount power inductor of claim 25, wherein the second width is greater than the first width.

27. The surface mount power inductor of claim 1, wherein the main winding section of the preformed C-shaped conductive winding clip is seated in the groove at a depth selected to reduce an acoustic noise while the power inductor is operating in an electrical circuit.

28. The surface mount power inductor of claim 27, wherein the groove has a depth from about 0.1 mm to about 0.5 mm.

29. The surface mount power inductor of claim 28, wherein the groove has depth of about 0.3 mm.

30. The surface mount power inductor of claim 27, wherein the groove has a depth selected to reduce the acoustic noise by about 4 dB.

31. The surface mount power inductor of claim 27, wherein the power inductor is operable with acoustic noise in a range of about 46 dB to about 49 dB in a power supply management circuit.

32. The surface mount power inductor of claim 31, wherein the power inductor is operable with acoustic noise of about 48 dB in the power supply management circuit.

33. The surface mount power inductor of claim 27, wherein the electrical circuit is a power supply management circuit and wherein the power inductor experiences a high-to-low or low-to-high current transition in the electrical circuit.

34. The surface mount power inductor of claim 27, in combination with a circuit board configured to implement power supply management circuitry.

35. The surface mount power inductor of claim 34, wherein the power supply management circuitry supplies power to a dynamic load.

36. The surface mount power inductor of claim 35, wherein the dynamic load comprises one of a CPU and a GPU.

37. The surface mount power inductor of claim 34, wherein the terminal lead sections are soldered to the board but the first shaped-core piece is not.

38. The surface mount power inductor of claim 1, wherein the first shaped-core piece has a different shape than the second shaped-core piece.

* * * * *